US009063508B2

(12) United States Patent
Ota et al.

(10) Patent No.: US 9,063,508 B2
(45) Date of Patent: Jun. 23, 2015

(54) CLEANING DEVICE AND IMAGE FORMING APPARATUS

(71) Applicant: KYOCERA Document Solutions Inc., Osaka (JP)

(72) Inventors: Katsuya Ota, Osaka (JP); Jun Nakai, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/278,863

(22) Filed: May 15, 2014

(65) Prior Publication Data

US 2014/0356041 A1 Dec. 4, 2014

(30) Foreign Application Priority Data

May 29, 2013 (JP) ..... 2013-113139

(51) Int. Cl.
*G03G 21/00* (2006.01)

(52) U.S. Cl.
CPC ..... *G03G 21/0011* (2013.01); *G03G 21/007* (2013.01); *G03G 21/0076* (2013.01); *G03G 2221/0015* (2013.01); *G03G 21/0058* (2013.01); *G03G 2221/001* (2013.01)

(58) Field of Classification Search
CPC ..... G03G 21/0011; G03G 21/0058; G03G 21/0076; G03G 21/007; G03G 2221/001; G03G 2221/007; G03G 2221/0015
USPC ..... 399/349
See application file for complete search history.

(56) References Cited

U.S. PATENT DOCUMENTS

| | | | | |
|---|---|---|---|---|
| 5,512,995 | A * | 4/1996 | Gerbasi | 399/353 |
| 5,884,124 | A * | 3/1999 | Karakama et al. | 399/123 |
| 8,676,109 | B2 | 3/2014 | Wakayama | |
| 2007/0292177 | A1 * | 12/2007 | Ishino et al. | 399/350 |
| 2012/0189363 | A1 * | 7/2012 | Wakayama | 399/349 |

FOREIGN PATENT DOCUMENTS

JP 2012-150312 A 8/2012

* cited by examiner

*Primary Examiner* — G. M. Hyder
*Assistant Examiner* — Tyler Hardman
(74) *Attorney, Agent, or Firm* — Knobbe, Martens, Olson & Bear LLP

(57) ABSTRACT

A drum cleaning device includes a toner supply roller, a toner layer restricting member, and a toner receiving member. The toner layer restricting member includes an inclined portion formed in a lateral region outside of an image forming region to incline gradually away from a surface of a cleaning roller with increasing distance from an inner side of the lateral region. The toner receiving member includes a lower-level upper end portion provided in the lateral region outside of the image forming region, the lower-level upper end portion being located below a second contact region where the cleaning roller and the toner supply roller come into contact with each other. The inclined portion is disposed in a region overlapping the lower-level upper end portion.

8 Claims, 6 Drawing Sheets

(LATERAL REGION OUTSIDE OF IMAGE FORMING REGION G)

CLEANING DEVICE AND IMAGE FORMING APPARATUS

INCORPORATION BY REFERENCE

This application claims priority to Japanese Patent Application No. 2013-113139 filed on May 29, 2013, the entire contents of which are incorporated by reference herein.

BACKGROUND

The present disclosure relates to a cleaning device for use in an image forming apparatus, such as a copier or a printer, and an image forming apparatus with the cleaning device.

There is known, as a cleaning device for use in an image forming apparatus, such as a copier, a cleaning device including: a cleaning roller disposed in contact with the surface of a photosensitive drum as an image carrier and configured to remove toner from the surface of the photosensitive drum; a cleaning blade configured to scrape off toner from the surface of the photosensitive drum; and a toner layer restricting member configured to restrict the thickness of a layer of toner deposited on the cleaning roller. The cleaning roller has not only the function of removing toner from the surface of the photosensitive drum but also the function of retaining toner on the surface of the cleaning roller to form a layer of toner and polishing the surface of the photosensitive drum with the formed layer of toner. The toner layer restricting member extends in a direction along a rotational axis of the cleaning roller and is configured to restrict the layer of toner deposited on the cleaning roller to a uniform thickness.

When, in such a cleaning device, for example, an image of low coverage rate is continuously printed on a large number of print sheets or an image with the print position lopsided in the direction of the rotational axis of the photosensitive drum is repeatedly printed on a large number of print sheets, the layer of toner formed on the surface of the cleaning roller may partially lack in amount, resulting in failure in uniform polishing of the entire surface of the photosensitive drum and thus uneven polishing.

To cope with this, an improved cleaning device is proposed in which the aforementioned cleaning device further includes a toner supply roller configured to supply toner to the cleaning roller and a toner receiving member configured to receive toner and supply the received toner to the toner supply roller. Since this cleaning device can supply toner to the cleaning roller with the toner supply roller, it is described as capable of reducing the lack of toner in the layer of toner deposited on the surface of the cleaning roller.

SUMMARY

A technique improved over the above technique is proposed as one aspect of the present disclosure.

A cleaning device according to one aspect of the present disclosure includes a cleaning roller, a cleaning blade, a toner supply roller, a toner layer restricting member, and a toner receiving member.

The cleaning roller is disposed in contact at a first contact region with a surface of an image carrier rotatable about a first rotational axis, is rotatable about a second rotational axis parallel to the first rotational axis, extends in a direction along the second rotational axis, and is configured to remove toner from the surface of the image carrier.

The cleaning blade is disposed in abutment against the surface of the image carrier downstream of the first contact region in a direction of rotation of the image carrier, extends in the direction along the second rotational axis, and is configured to scrape off toner from the surface of the image carrier.

The toner supply roller is disposed in contact at a second contact region with a surface of the cleaning roller, is rotatable about a third rotational axis parallel to the second rotational axis, extends in a direction along the third rotational axis, and is configured to supply toner to the cleaning roller.

The toner layer restricting member is disposed in abutment against the surface of the cleaning roller downstream of the second contact region in a direction of rotation of the cleaning roller, extends in the direction along the second rotational axis, and is configured to restrict a thickness of a layer of toner deposited on the cleaning roller.

The toner receiving member is disposed apart from and facing the toner supply roller downstream of the second contact region in a direction of rotation of the toner supply roller, extends in the direction along the third rotational axis, includes a toner receiving surface facing a peripheral surface of the toner supply roller, and is configured to receive toner having passed through the second contact region and supply the received toner to the toner supply roller.

Furthermore, the toner layer restricting member includes an inclined portion formed in a lateral region outside of an image forming region to incline gradually away from the surface of the cleaning roller with increasing distance from an inner side of the lateral region in the direction along the second rotational axis.

The toner receiving member includes a lower-level upper end portion provided in the lateral region outside of the image forming region and the lower-level upper end portion is located below the second contact region.

The inclined portion is disposed in a region overlapping the lower-level upper end portion when viewed from a direction perpendicular to the direction along the second rotational axis.

An image forming apparatus according to another aspect of the present disclosure includes the aforementioned cleaning device, an image carrier having a surface on which an electrostatic latent image is to be formed, and a developing device configured to develop the electrostatic latent image formed on the image carrier into a toner image.

A cleaning device according to still another aspect of the present disclosure includes a cleaning roller, a cleaning blade, a toner supply roller, a toner layer restricting member, and a toner receiving member.

The cleaning roller is disposed in contact at a first contact region with a surface of a member rotatable about a first rotational axis, is rotatable about a second rotational axis parallel to the first rotational axis, extends in a direction along the second rotational axis, and is configured to remove toner from the surface of the member.

The cleaning blade is disposed in abutment against the surface of the member downstream of the first contact region in a direction of rotation of the member, extends in the direction along the second rotational axis, and is configured to scrape off toner from the surface of the member.

The toner supply roller is disposed in contact at a second contact region with a surface of the cleaning roller, is rotatable about a third rotational axis parallel to the second rotational axis, extends in a direction along the third rotational axis, and is configured to supply toner to the cleaning roller.

The toner layer restricting member is disposed in abutment against the surface of the cleaning roller downstream of the second contact region in a direction of rotation of the cleaning roller, extends in the direction along the second rotational axis, and is configured to restrict a thickness of a layer of toner deposited on the cleaning roller.

The toner receiving member is disposed apart from and facing the toner supply roller downstream of the second contact region in a direction of rotation of the toner supply roller, extends in the direction along the third rotational axis, includes a toner receiving surface facing a peripheral surface of the toner supply roller, and is configured to receive toner having passed through the second contact region and supply the received toner to the toner supply roller.

Furthermore, the toner layer restricting member includes an inclined portion formed in a lateral region outside of an image forming region to incline gradually away from the surface of the cleaning roller with increasing distance from an inner side of the lateral region in the direction along the second rotational axis.

The toner receiving member includes a lower-level upper end portion provided in the lateral region outside of the image forming region and the lower-level upper end portion is located below the second contact region.

The inclined portion is disposed in a region overlapping the lower-level upper end portion when viewed from a direction perpendicular to the direction along the second rotational axis.

DETAILED DESCRIPTION

A description will be given below of one embodiment of the present disclosure with reference to the drawings.

Figure 1:
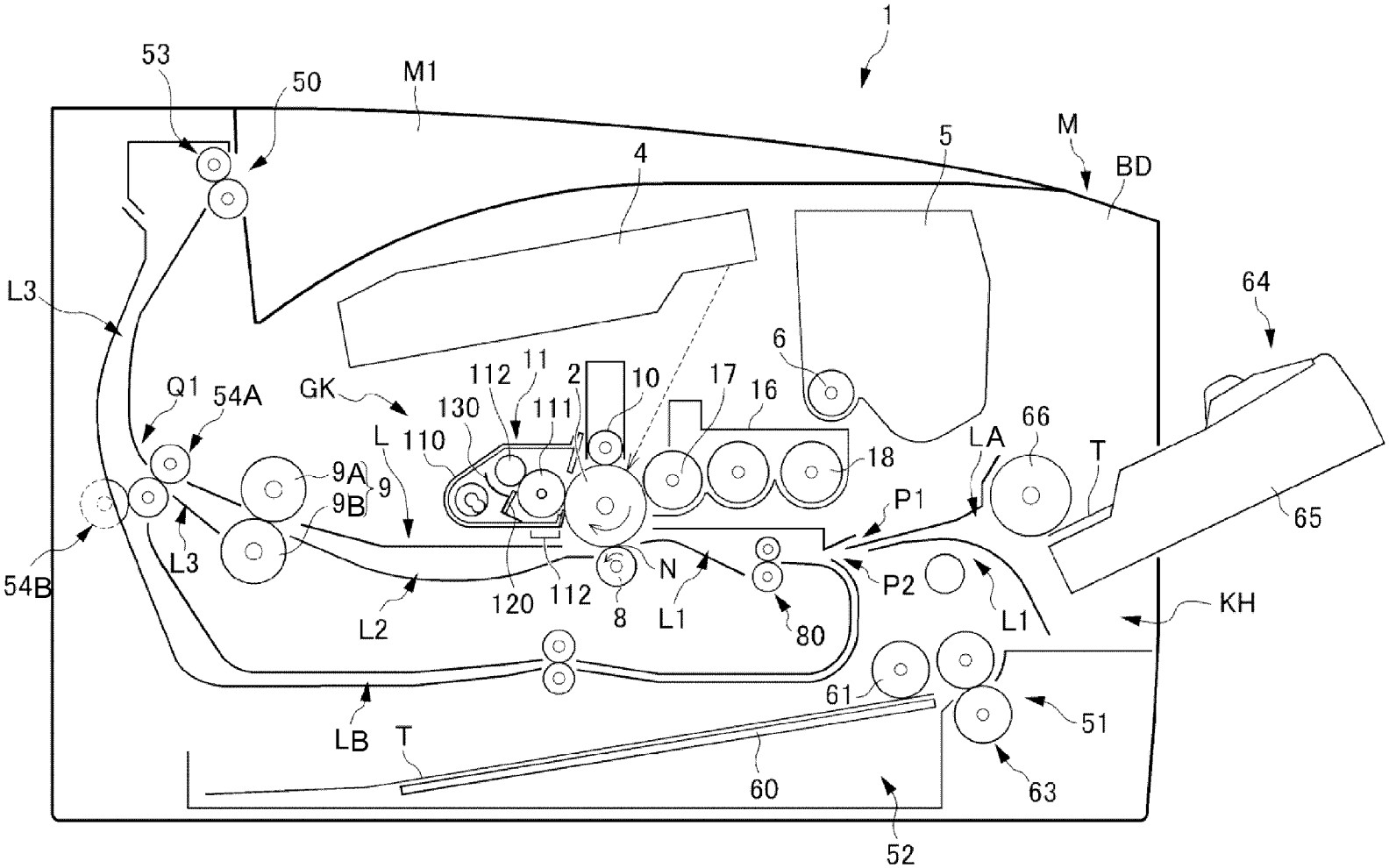
FIG. 1 is a view for illustrating the arrangement of component elements of a printer according to one embodiment of the present disclosure.

First, a description will be given of a general structure of a printer 1 as an image forming apparatus according to the one embodiment of the present disclosure with reference to FIG. 1. FIG. 1 is a view for illustrating the arrangement of component elements of the printer 1 according to the one embodiment of the present disclosure.

As shown in FIG. 1, the printer 1 as the image forming apparatus includes an apparatus main unit M, an image forming section GK configured to form a given toner image on a paper sheet T serving as a recording sheet material for use in image transfer based on given image data, and a paper feed/discharge section KH configured to feed the paper sheet T to the image forming section GK and discharge the paper sheet T having the toner image formed thereon.

The outer shape of the apparatus main unit M is defined by a case body BD serving as a housing.

As shown in FIG. 1, the image forming section GK includes a photosensitive drum 2 serving as the image carrier (a photoconductor), a charging section 10, a laser scanner unit 4 serving as an exposure unit, a developing device 16, a toner cartridge 5, a toner supply section 6, a drum cleaning device 11 serving as the cleaning device, a static eliminator 12, a transfer roller 8, and a fixing section 9.

As shown in FIG. 1, the paper feed/discharge section KH includes a paper feed cassette 52, a manual paper feed section 64, a conveyance path L for paper sheets T, a registration roller pair 80, and a paper discharge section 50.

The structures of the image forming section GK and the paper feed/discharge section KH will be described below in detail.

First, the image forming section GK will be described.

In the image forming section GK, the following operations are performed in order from upstream to downstream in a direction of rotation of the photosensitive drum 2 along the surface of the photosensitive drum 2: charging of the charging section 10, exposure of the laser scanner unit 4, development of the developing device 16, image transfer of the transfer roller 8, static elimination of the static eliminator 12, and cleaning of the drum cleaning device 11.

The photosensitive drum 2 is formed of a cylindrical member and functions as a photoconductor or an image carrier. The photosensitive drum 2 is disposed rotatably in the direction of the arrow about a first rotational axis J1 (see FIGS. 2A and 2B) extending in a direction perpendicular to a direction of conveyance of the paper sheet T in the conveyance path L. An electrostatic latent image can be formed on the surface of the photosensitive drum 2.

The charging section 10 is disposed facing the surface of the photosensitive drum 2. The charging section 10 is configured to uniformly charge the surface of the photosensitive drum 2 negatively (to give a negative polarity) or positively (to give a positive polarity).

The laser scanner unit 4 functions as the exposure unit and is disposed apart from the surface of the photosensitive drum 2. The laser scanner unit 4 includes an unshown laser source, a polygon mirror, a motor for driving the polygon mirror, and so on.

The laser scanner unit 4 is configured to scan-expose the surface of the photosensitive drum 2 to light based on image data input from an external device, such as a personal computer (PC). By the scan-exposure of the laser scanning unit 4, charge on the exposed portion of the surface of the photosensitive drum 2 is removed. Thus, an electrostatic latent image is formed on the surface of the photosensitive drum 2.

The developing device 16 is provided in association with the photosensitive drum 2 and disposed facing the surface of the photosensitive drum 2. The developing device 16 is configured to cause monochromatic color (generally, black) toner to be attracted to the electrostatic latent image formed on the photosensitive drum 2 and thereby form a monochromatic toner image on the surface of the photosensitive drum 2. The developing device 16 includes a developing roller 17 disposed facing the surface of the photosensitive drum 2, an agitating roller 18 for use in agitating toner, and so on.

The toner cartridge 5 is provided in association with the developing device 16 and configured to contain toner to be supplied to the developing device 16.

The toner supply section 6 is provided in association with the toner cartridge 5 and the developing device 16 and configured to supply the toner contained in the toner cartridge 5 to the developing device 16. The toner supply section 6 and the developing device 16 are connected via an unshown toner supply passage.

The transfer roller 8 is configured to transfer the toner image developed on the surface of the photosensitive drum 2 to the paper sheet T. An unshown transfer bias applying section applies to the transfer roller 8 a transfer bias for transferring the toner image formed on the photosensitive drum 2 to the paper sheet T. The transfer roller 8 is configured to be rotatable in contact with the photosensitive drum 2.

The paper sheet T being conveyed along the conveyance path L is nipped between the photosensitive drum 2 and the transfer roller 8. The nipped paper sheet T is pressed against the surface of the photosensitive drum 2. Thus, a transfer nip N is formed between the photosensitive drum 2 and the transfer roller 8. In the transfer nip N, the toner image developed on the photosensitive drum 2 is transferred to the paper sheet T.

The static eliminator 12 is disposed facing the surface of the photosensitive drum 2. The static eliminator 12 is configured to irradiate the surface of the photosensitive drum 2 after subjected to the transfer process with light to eliminate static electricity (remove residual charge) from the surface of the photosensitive drum 2.

The drum cleaning device 11 is disposed facing the surface of the photosensitive drum 2. The drum cleaning device 11 is configured to remove residual toner and deposits on the surface of the photosensitive drum 2 and convey the removed toner and deposits to a designated recovery mechanism to allow the recovery mechanism to recover them. Details of the drum cleaning device 11 will be described hereinafter.

The fixing section 9 is configured to melt and press the toner forming the toner image transferred to the paper sheet T to fix it on the paper sheet T. The fixing section 9 includes a heat rotor 9A capable of being heated by a heater; and a pressure rotor 9B capable of being pressed against the heat rotor 9A. The heat rotor 9A and the pressure rotor 9B are configured to nip the paper sheet T having the toner image transferred thereto and convey the paper sheet T while pressing it. When the paper sheet T is conveyed as it is nipped between the heat rotor 9A and the pressure rotor 9B, the toner transferred to the paper sheet T is melted and pressed, resulting in toner fixation on the paper sheet T.

Next, the paper feed/discharge section KH will be described.

As shown in FIG. 1, a single paper feed cassette 52 capable of containing paper sheets T is disposed in a lower part of the apparatus main unit M. The paper feed cassette 52 is equipped with a loading plate 60 on which paper sheets T are to be placed. The cassette paper feed section 51 includes a multi-feed prevention mechanism composed of a forward feed roller 61 configured to pick up the paper sheets T on the loading plate 60 and a paper feed roller pair 63 configured to feed the paper sheets T one by one to the conveyance path L.

The manual paper feed section 64 is provided on the right side of the apparatus main unit M (the right side thereof in FIG. 1). The manual paper feed section 64 includes: a manual feed tray 65 forming a portion of the right side surface of the apparatus main unit M when closed; and a paper feed roller 66.

A first junction P1 and a second junction P2 are provided halfway through a first conveyance path L1. A first bifurcation Q1 is provided halfway through a third conveyance path L3.

The first junction P1 is a junction at which a manual feed conveyance path LA joins the first conveyance path L1. The second junction P2 is a junction at which a return conveyance path LB joins the first conveyance path L1.

The first bifurcation Q1 is a bifurcation at which the return conveyance path LB branches off from the third conveyance path L3 and the first bifurcation Q1 includes a first roller pair 54A and a second roller pair 54B. One roller of the first roller pair 54A is also used as one roller of the second roller pair 54B.

Disposed halfway through the first conveyance path L1 (specifically, between the second junction P2 and the transfer roller 8) are a sensor for use in the detection of the paper sheet T and a registration roller pair 80 for use in the correction of skew (oblique feed) of the paper sheet T and the timing synchronization of the formation of a toner image in the image forming section GK with the conveyance of the paper sheet T.

A discharged sheet accumulating section M1 is formed on the opening side of the paper discharge section 50.

Figure 2A:
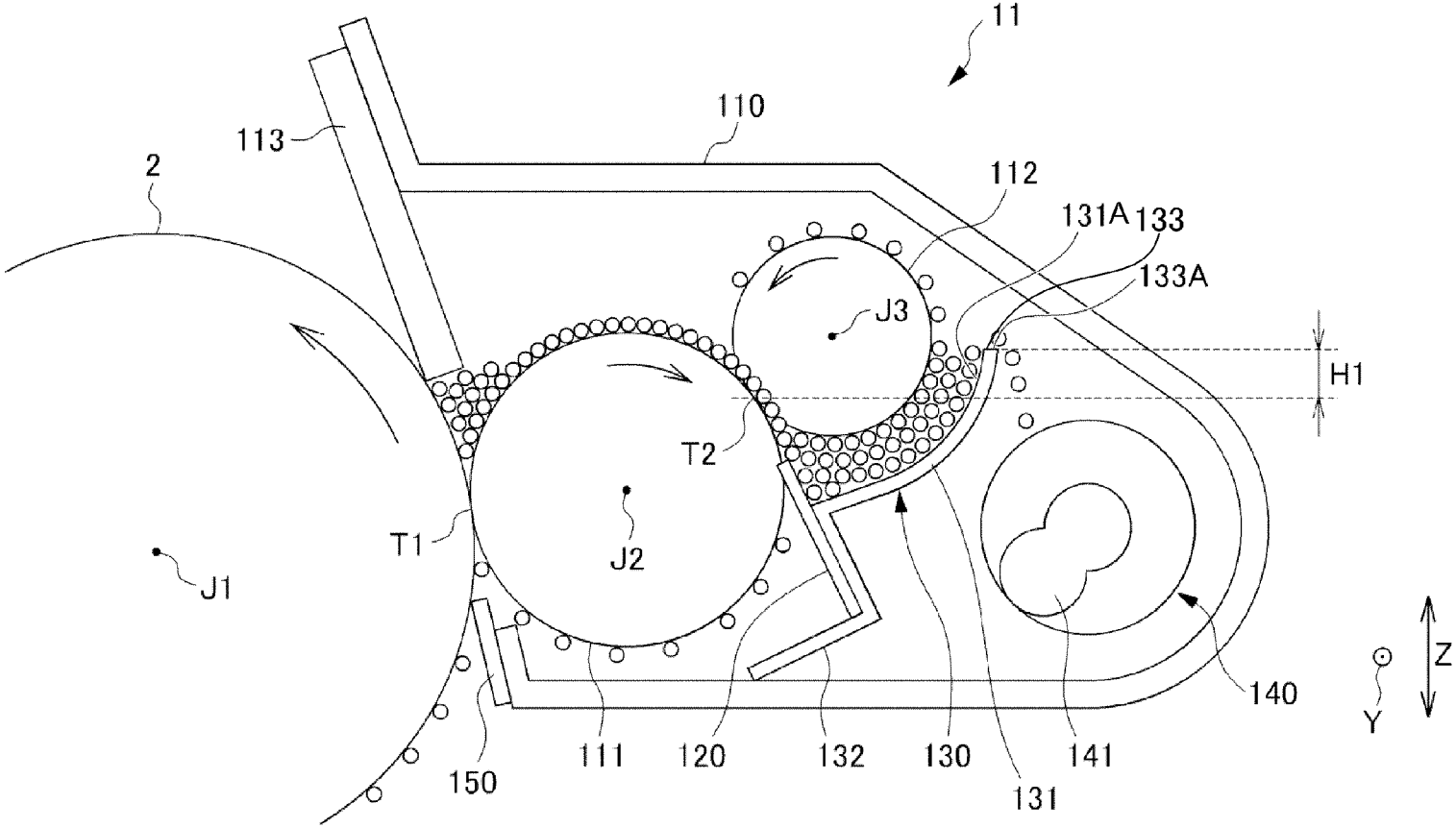
FIG. 2A is a cross-sectional view for illustrating component elements of a drum cleaning device according to the one embodiment of the present disclosure in an image forming region G.
Figure 2B:
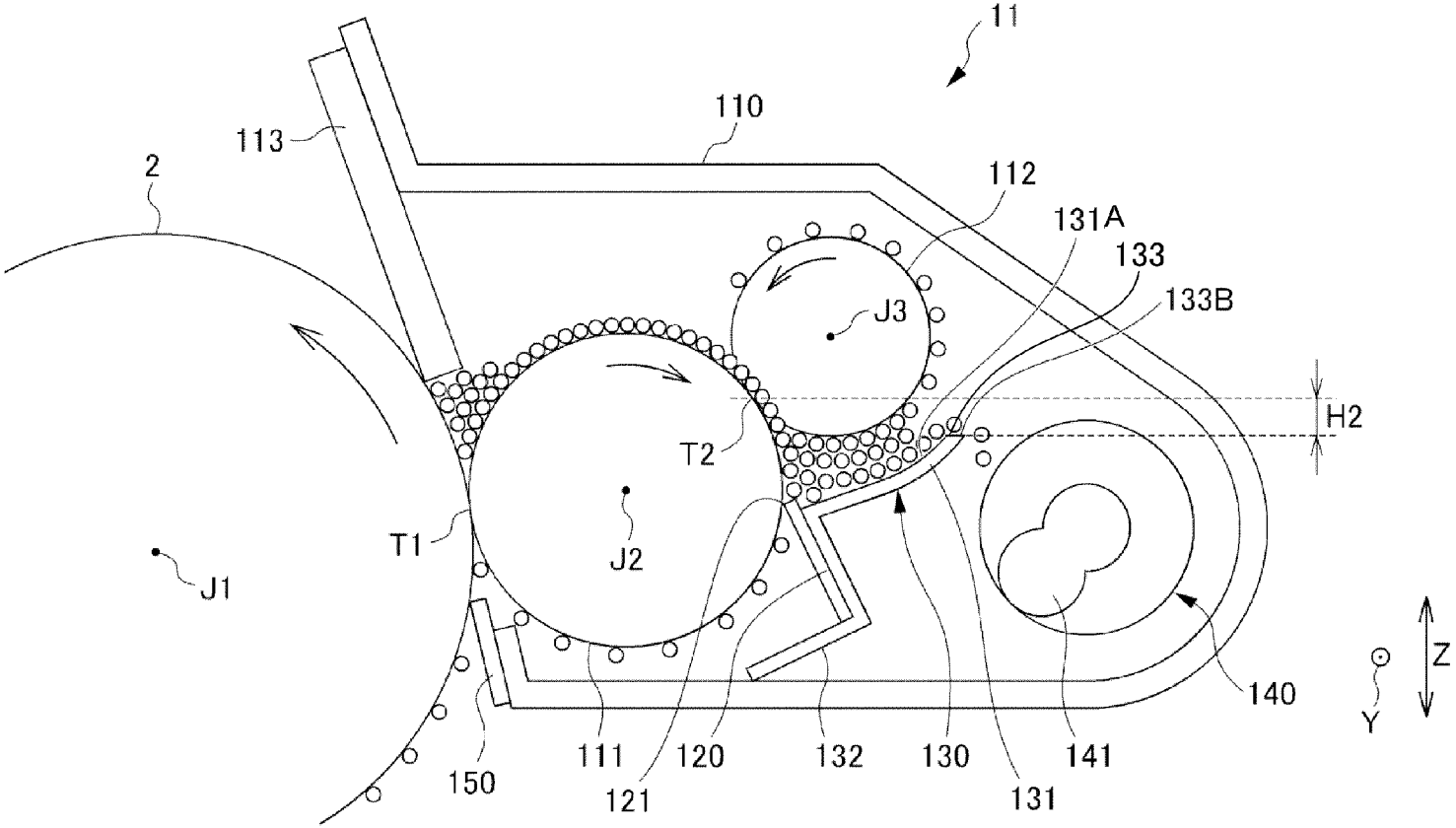
FIG. 2B is a cross-sectional view for illustrating component elements of the drum cleaning device according to the one embodiment of the present disclosure in a lateral region outside of the image forming region G.
Figure 3:
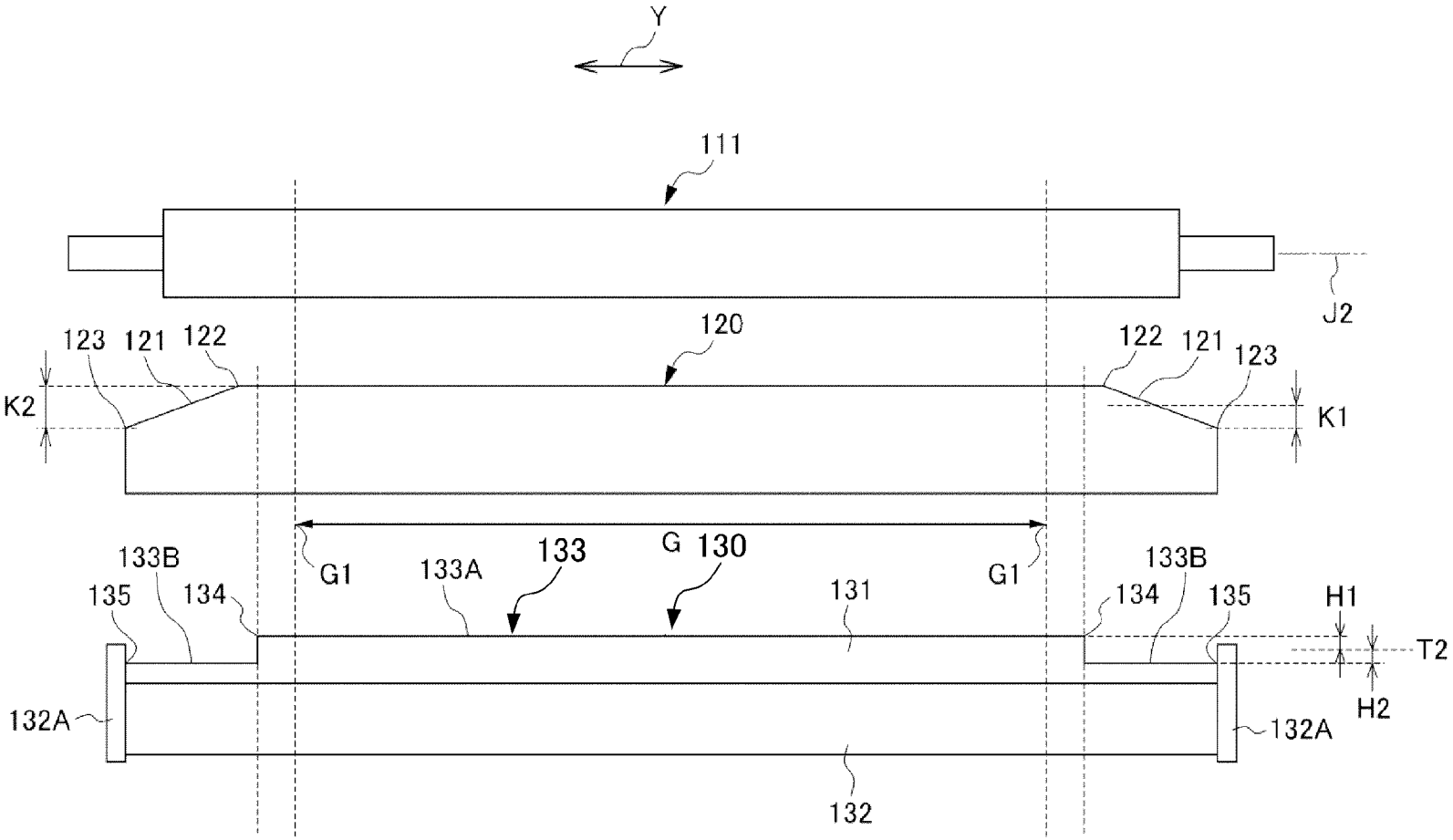
FIG. 3 is a view for illustrating the positional relationship in a direction Y transverse to a direction of conveyance among a cleaning roller, a toner layer restricting member, and a toner receiving member in the one embodiment of the present disclosure.
Figure 4:
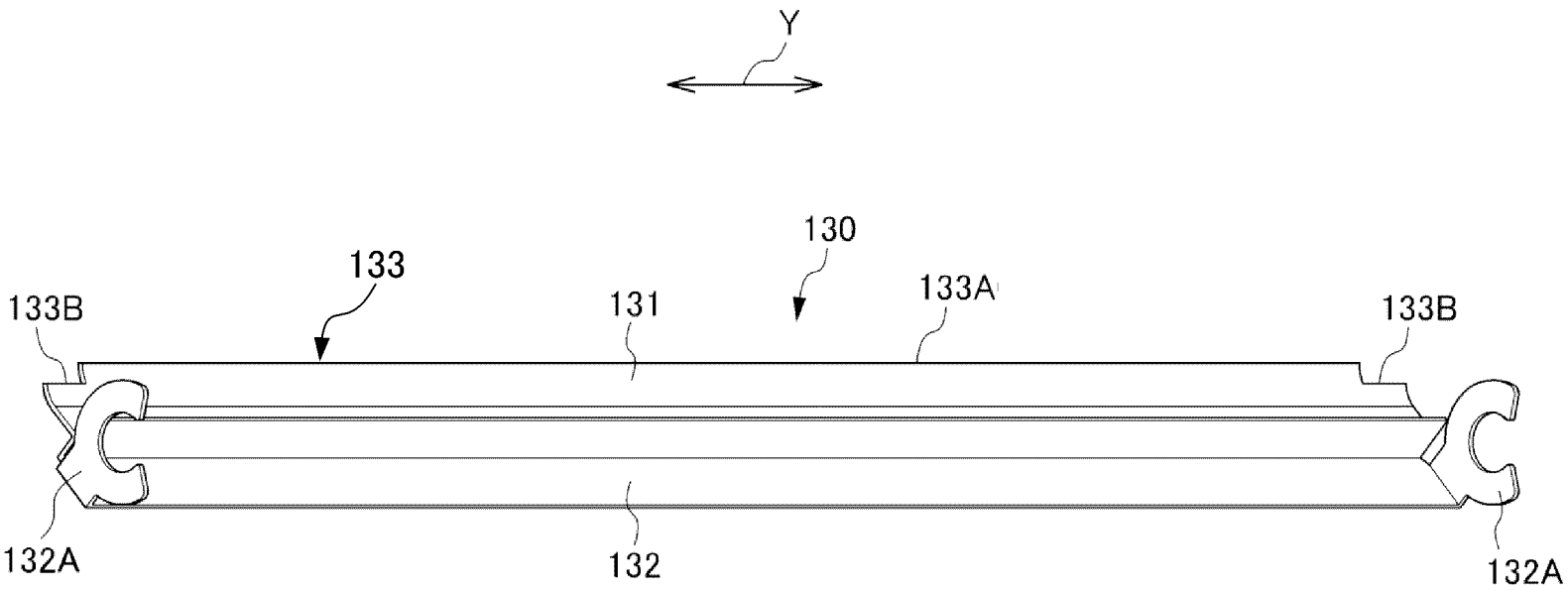
FIG. 4 is a perspective view showing the toner receiving member in the one embodiment of the present disclosure.

Next, a description will be given of details of the drum cleaning device 11 according to the one embodiment of the present disclosure with reference to FIGS. 1 to 4. FIG. 2A is a cross-sectional view for illustrating component elements of the drum cleaning device 11 according to the one embodiment of the present disclosure in an image forming region G. FIG. 2B is a cross-sectional view for illustrating component elements of the drum cleaning device 11 according to the one embodiment of the present disclosure in a lateral region outside of the image forming region G. FIG. 3 is a view for illustrating the positional relationship in a direction Y transverse to the direction of conveyance among a cleaning roller 111, a toner layer restricting member 120, and a toner receiving member 130 in the one embodiment of the present disclosure. FIG. 4 is a perspective view showing the toner receiving member 130 in the one embodiment of the present disclosure.

The following detailed description of the drum cleaning device 11 with reference to FIGS. 2A and 2B will be given as viewed from the back side of FIG. 1 (the back side of the printer 1). FIG. 2A shows a cross section of the drum cleaning device 11 in an image forming region G and FIG. 2B shows a cross section of the drum cleaning device 11 in a lateral region outside of the image forming region G.

As shown in FIGS. 2A and 2B, the drum cleaning device 11 includes a housing 110, a cleaning roller 111, a toner supply roller 112, a cleaning blade 113, a toner layer restricting member 120, a toner receiving member 130, a waste toner discharge screw 140, and a toner leak preventing sheet 150.

The housing 110 of the drum cleaning device 11 contains the cleaning roller 111, the toner supply roller 112, the toner layer restricting member 120, the toner receiving member 130, and the waste toner discharge screw 140. The housing 110 is a casing the side of which facing the photosensitive drum 2 is open.

The cleaning roller 111, the toner supply roller 112, the cleaning blade 113, the waste toner discharge screw 140, and the toner leak preventing sheet 150 have substantially the same length as the axial length of the photosensitive drum 2. The toner layer restricting member 120 and the toner receiving member 130 have substantially the same length in the longitudinal direction and are formed to be longer than the axial length of the cleaning roller 111 (see FIG. 3).

The cleaning roller 111 and the cleaning blade 113, as shown in FIGS. 2A and 2B, are provided to come into contact with the surface of the photosensitive drum 2 from which the toner image has been transferred to the transfer roller 8 (see FIG. 1) and are configured to remove residual toner and deposits on the surface of the photosensitive drum 2 to clean the surface of the photosensitive drum 2.

The cleaning roller 111 is formed of a cylindrical member and is a roller configured to remove toner from the surface of the photosensitive drum 2. Furthermore, the cleaning roller 111 is a roller configured to retain toner on its surface to form a layer of toner and polish the surface of the photosensitive drum 2 with the layer of toner formed on its surface. The cleaning roller 111 is disposed in contact at a first contact region T1 with the surface of the photosensitive drum 2, the first contact region T1 lying downstream of the transfer nip N (see FIG. 1), which is formed between the cleaning roller 111 and the transfer roller 8, in the direction of rotation of the photosensitive drum 2.

The cleaning roller 111 is rotatable about a second rotational axis J2 parallel to the first rotational axis J1 of the photosensitive drum 2 in the direction of the arrow shown in FIGS. 2A and 2B. The rotating cleaning roller 111 runs in the same direction as the rotating photosensitive drum 2 when located at the first contact region T1 where the photosensitive drum 2 and the cleaning roller 111 come into contact with each other. The cleaning roller 111 can polish the surface of the photosensitive drum 2 by rotation with a difference in circumferential speed from the rotation of the photosensitive drum 2. The cleaning roller 111 extends in the direction along the second rotational axis J2. In this embodiment, the direction which is parallel to the direction along the first rotational axis J1, the direction along the second rotational axis J2, and the direction along a third rotational axis J3 (to be described later) is referred to as a "direction Y transverse to the direction of conveyance".

Toner removed from the surface of the photosensitive drum 2 is deposited on the surface of the cleaning roller 111. The toner deposited on the surface of the cleaning roller 111 is conveyed downstream in the direction of rotation of the cleaning roller 111 by the rotation of the cleaning roller 111.

On the other hand, toner unremoved by the cleaning roller 111 and remaining on the surface of the photosensitive drum 2 is conveyed toward the cleaning blade 113 located downstream in the direction of rotation of the photosensitive drum 2 as it is deposited on the surface of the photosensitive drum 2.

The cleaning blade 113 is a member configured to scrape off toner from the surface of the photosensitive drum 2. The cleaning blade 113 is formed of a rectangular plate material.

A distal end of the cleaning blade 113 abuts against a portion of the surface of the photosensitive drum 2 located near the first contact region T1 where the photosensitive drum 2 and the cleaning roller 111 come into contact with each other and located downstream of the first contact region T1 in the direction of rotation of the photosensitive drum 2. A basal end portion of the cleaning blade 113 (an end portion thereof opposite to the distal end abutting against the surface of the photosensitive drum 2) is mounted to the housing 110 via an unshown mounting plate.

The cleaning blade 113 extends in the direction Y transverse to the direction of conveyance (in the direction along the first rotational axis J1) and is disposed to abut against the photosensitive drum 2 in a counter direction. The counter direction of the cleaning blade 113 means that, at a point where the cleaning blade 113 abuts against the photosensitive drum 2, the direction from the basal end to the distal end of the cleaning blade 113 is opposed to the direction of rotation of the photosensitive drum 2.

The toner layer restricting member 120 is a member configured to scrape off toner from the surface of the cleaning roller 111 to restrict the thickness of a layer of toner deposited on the cleaning roller 111. The toner layer restricting member 120 scrapes off toner deposited on the surface of the cleaning roller 111 and having passed through a second contact region T2 (to be described later) where the cleaning roller 111 and the toner supply roller 112 (to be described later) come into contact with each other.

The toner layer restricting member 120 is disposed in abutment against the surface of the cleaning roller 111 downstream of the second contact region T2, at which the cleaning roller 111 and the toner supply roller 112 (to be described later) come into contact with each other, in the direction of rotation of the cleaning roller 111. The toner layer restricting member 120 is formed of a rectangular plate material.

A distal end of the toner layer restricting member 120 abuts against the surface of the cleaning roller 111 on the side of the cleaning roller 111 opposite to the photosensitive drum 2. A basal end portion of the toner layer restricting member 120 (an end portion thereof opposite to the distal end abutting against the surface of the cleaning roller 111) is mounted to a toner receiver support 132 (to be described later).

The toner layer restricting member 120, as shown in FIGS. 2A and 2B, extends in the direction Y transverse to the direction of conveyance (in the direction along the second rotational axis J2) and is disposed to abut against the cleaning roller 111 in a counter direction. The counter direction of the toner layer restricting member 120 means that, at a point where the toner layer restricting member 120 abuts against the cleaning roller 111, the direction from the basal end to the distal end of the toner layer restricting member 120 is opposed to the direction of rotation of the cleaning roller 111.

The toner layer restricting member 120, as shown in FIG. 3, includes inclined portions 121 in both lateral regions outside of the image forming region G. Each inclined portion 121 extends linearly and inclines gradually away from the surface of the cleaning roller 111 with increasing distance from the inner side of the lateral region in the direction Y transverse to the direction of conveyance.

In the lateral regions outside of the image forming region G as shown in FIGS. 2B and 3, the amount K1 of bite of the inclined portions 121 into the cleaning roller 111 is 0.1 mm or less. In this embodiment, the amount K1 of bite of the inclined portions 121 into the cleaning roller 111 is, for example, 0.1 mm.

On the other hand, in the image forming region G shown in FIGS. 2A and 3, which is a region of the toner layer restricting member 120 located inwardly of the inclined portions 121 in the direction Y transverse to the direction of conveyance, the amount K2 of bite of the toner layer restricting member 120 into the cleaning roller 111 is greater than 0.1 mm. In this embodiment, the amount K2 of bite of the toner layer restricting member 120 into the cleaning roller 111 is, for example, 0.5 mm.

The toner supply roller 112, as shown in FIGS. 2A and 2B, is formed of a cylindrical member and is a roller configured to supply toner to the cleaning roller 111. The toner supply roller 112 is disposed on the side of the cleaning roller 111 opposite to the photosensitive drum 2. The toner supply roller 112 is disposed in contact at the second contact region T2 with the surface of the cleaning roller 111. The toner supply roller 112 is rotatable about a third rotational axis J3 parallel to the second rotational axis J2 in the direction of the arrow shown in FIGS. 2A and 2B. The rotating toner supply roller 112 runs in the same direction as the rotating cleaning roller 111 when located at the second contact region T2 where the cleaning roller 111 and the toner supply roller 112 come into contact with each other. The toner supply roller 112 extends in the direction along the third rotational axis J3. The toner supply roller 112 is supplied with toner received by the toner receiving member 130 (to be described later in detail). The toner supply roller 112 is configured to rotate as toner accumulated thereon by supply from the toner receiving member 130 is deposited thereon.

Furthermore, the toner supply roller 112 is configured to push out the toner received by and accumulated on the toner receiving member 130 (to be described later) toward the waste toner discharge screw 140 and allow the toner to fall down from an upper end portion 133 of the toner receiving member 130 toward the waste toner discharge screw 140.

The toner receiving member 130 is configured to receive toner having passed through the second contact region T2 where the cleaning roller 111 and the toner supply roller 112 come into contact with each other. Then, the toner receiving member 130 supplies the received toner to the toner supply roller 112.

The toner receiving member 130, as shown in FIGS. 2A and 2B, is disposed apart from and facing the toner supply roller 112 downstream of the second contact region T2, at which the cleaning roller 111 and the toner supply roller 112 come into contact with each other, in the direction of rotation of the toner supply roller 112. The toner receiving member 130 extends in the direction along the third rotational axis J3 and also extends along the circumferential direction of the toner supply roller 112.

The toner receiving member 130, as shown in FIGS. 2A to 4, includes a toner receiving member body 131, a toner receiver support 132 supporting the toner receiving member body 131, and a pair of hook members 132A, 132A (see FIG. 4) provided at both ends of the toner receiver support 132 in the direction Y transverse to the direction of conveyance. The toner receiving member body 131, as shown in FIGS. 2A and 2B, is formed apart from and along the peripheral surface of the toner supply roller 112. The toner receiving member body 131 is formed to have a curvature bulging downward when viewed in the direction Y transverse to the direction of conveyance. As seen from the view in the direction Y transverse to the direction of conveyance, the toner receiving member body 131 includes an upper end portion 133 one end of which is supported by the toner receiver support 132 and the other end of which is formed of a free end.

The toner receiving member body 131, as shown in FIGS. 2A and 2B, has a toner receiving surface 131A. The toner receiving surface 131A faces the peripheral surface of the toner supply roller 112. The toner receiving surface 131A is formed in a surface curved along the peripheral surface of the toner supply roller 112. Toner having passed through the second contact region T2 is accumulated on the toner receiving surface 131A.

The toner receiver support 132, as shown in FIGS. 2A and 2B, has a substantially L-shaped cross section when viewed in the direction Y transverse to the direction of conveyance and is connected to one end of the toner receiving member body 131.

The pair of hook members 132A, 132A, as shown in FIGS. 3 and 4, are provided at both ends of the toner receiver support 132 in the direction Y transverse to the direction of conveyance. Each of the pair of hook members 132A, 132A is formed of a plate material and formed in a substantially C-shape. The toner receiver support 132 is mounted to the drum cleaning device 11 by the pair of hook members 132A, 132A through a bearing supporting the cleaning roller 111 and the toner supply roller 112.

The upper end portion 133 of the toner receiving member body 131 is composed of a first upper end portion 133A (see FIG. 2A) as the upper-level upper end portion and a pair of second upper end portions 133B, 133B (see FIG. 2B) as the lower-level upper end portions.

The first upper end portion 133A, as shown in FIGS. 2A and 3, extends horizontally in the image forming region G (see FIG. 3) and is formed at the upper end of the toner receiving member body 131 in a vertical direction Z. The first upper end portion 133A is formed to be a first height H1 higher in the vertical direction Z than the second contact region T2 where the cleaning roller 111 and the toner supply roller 112 come into contact with each other.

The pair of second upper end portions 133B, 133B, as shown in FIGS. 2B and 3, are formed on both the lateral sides of the first end portion 133A in the direction Y transverse to the direction of conveyance. The second upper end portions 133B, 133B are formed, in the lateral regions (see FIG. 3) outside of the image forming region G, at the upper end of the toner receiving member body 131 in the vertical direction Z. The second upper end portions 133B, 133B extend horizontally in the lateral regions outside of the image forming region G and is formed to have a smaller height than the first upper end portion 133A. The second upper end portions 133B, 133B are formed to be a second height H2 lower in the vertical direction Z than the second contact region T2 where the cleaning roller 111 and the toner supply roller 112 come into contact with each other.

The second contact region T2 may have a certain vertical contact length. Specifically, this applies to the case where the cleaning roller 111 and the toner supply roller 112 make contact by pressing against each other. The height from the second contact region T2 in this case is determined with reference to the center of height of the second contact region T2 having the certain vertical contact length.

A description will now be given of the positional relationship in the direction Y transverse to the direction of conveyance between the inclined portions 121 and the associated second upper end portions 133B. The outer end 123 of each inclined portion 121 and the outer end 135 of the associated second upper end portion 133B are located at the same position in the direction Y transverse to the direction of conveyance. On the other hand, the inner end 122 of each inclined portion 121 is located outwardly of the inner end 134 of the associated second upper end portion 133B in the direction Y transverse to the direction of conveyance.

Specifically, when viewed perpendicularly to the direction Y transverse to the direction of conveyance (the direction along the second rotational axis J2), each of the inclined portions 121 of the toner layer restricting member 120 is disposed in a region overlapping (partially contained in) the associated second upper end portion 133B of the toner receiving member 130 in the direction Y transverse to the direction of conveyance.

In other words for the positional relationship between the second upper end portions 133B and the inclined portions 121 in the direction Y transverse to the direction of conveyance, as shown in FIG. 3, the lateral ends G1 of the image forming region G, the inner ends 134 of the second upper end portions 133B, and the inner ends 122 of the inclined portions 121 are located in this order outward from the lateral ends G1 of the image forming region G in the direction Y transverse to the direction of conveyance and, then, the outer ends 123 of the inclined portions 121 and the outer ends 135 of the second upper end portions 133B are located at further outward positions. The outer end 123 of each inclined portion 121 and the outer end 135 of the associated second upper end portion 133B are located at the same position in the direction Y transverse to the direction of conveyance.

The inner end 134 of each of the second upper end portions 133B, 133B in the direction Y transverse to the direction of conveyance, as shown in FIG. 3, is located between a portion of the toner receiving member 130 corresponding to the image forming region G and a portion thereof corresponding to the associated inclined portion 121 of the toner layer restricting member 120 in the direction Y transverse to the direction of conveyance.

The waste toner discharge screw 140, as shown in FIGS. 2A and 2B, is disposed in the interior of the housing 110 on the side of the toner receiving member body 131 opposite to the toner supply roller 112. The waste toner discharge screw 140 includes an unshown rotating shaft and a blade 141 formed to intersect with the rotating shaft. The waste toner discharge screw 140 is configured to, with its rotation about the rotating shaft (not shown), extrude waster toner in a direction of extension of the rotating shaft and discharge the waste toner toward an unshown waste toner container.

The toner leak preventing sheet 150 is disposed upstream of the cleaning roller 111 in the direction of rotation thereof to close a gap between the cleaning roller 111 and the housing 110. The toner leak preventing sheet 150 is configured to prevent toner and other deposits removed by the cleaning roller 111 and the cleaning blade 113 from getting spattered to the outside of the housing 110. The toner leak preventing sheet 150 is formed of, for example, an urethane sheet.

A description will next be given of the reason why the amount K1 of bite of the inclined portions 121 into the cleaning roller 111 is 0.1 mm or less and the reason why the height of the second upper end portions 133B of the toner receiving member 130 is set lower than the height of the second contact region T2 where the cleaning roller 111 and the toner supply roller 112 come into contact with each other.

Specifically, experimental results of the following Experiments 1 to 3 showed that it is necessary to set the amount K1 of bite of the inclined portions 121 into the cleaning roller 111 at 0.1 mm or less and set the height of the second upper end portions 133B of the toner receiving member 130 lower than the height of the second contact region T2 where the cleaning roller 111 and the toner supply roller 112 come into contact with each other.

Experiment 1

In Experiment 1, an examination was conducted on the amount of bite of the inclined portions 121 into the ends of the cleaning roller 111 in the direction Y transverse to the direction of conveyance from the viewpoint of whether or not the toner layer restricting member 120 was recurved at the ends in the direction Y transverse to the direction of conveyance depending upon the amount of bite of the inclined portions 121. Based on the examination results, the suitable amount of bite of the inclined portions 121 into the cleaning roller 111 was determined.

The conditions of Experiment 1 are as follows:

A black-and-white printer was used.

The photosensitive drum used was a 30 mm diameter A-Si (amorphous silicon) drum. The photosensitive drum was rotated at a linear velocity of 410 mm/s.

The development system used was a single component magnetic development system.

The transfer member used was a 20 mm diameter roller in which a foam (thickness: 6 mm) made of EPDM was wrapped around an 8 mm diameter metal shaft and which had a resistance of 6.5 log Ω.

The charging system used was a contact charging roller system and the charging roller used was a 9.5 mm diameter roller made of epichlorohydrin rubber. The shaft used in the charging roller was a 6 mm diameter shaft.

The following components were used in the cleaning device 11.

The cleaning blade 113 used was one made of urethane rubber and having a thickness t of 2.0 mm.

The cleaning roller 111 used was one made of EPDM and having a diameter of 14 mm. The shaft used in the cleaning roller 111 was a 10 mm diameter shaft. The linear velocity ratio of the photosensitive drum 2 to the cleaning roller 111 was 1.2 (in terms of forward rotation) and the drive-side and driven-side loads of the cleaning roller 111 on the photosensitive drum 2 were 15N and 9N, respectively.

The toner supply roller 112 used was one made of urethane foam and having a diameter of 10 mm. The shaft used in the toner supply roller 112 was a 6 mm diameter shaft. The linear velocity ratio of the cleaning roller 111 to the toner supply roller 112 was 1.0 (in terms of forward driven rotation) and the amount of bite of the toner supply roller 112 into the cleaning roller 111 was 0.5 mm.

The toner layer restricting member 120 used was one made of SUS and having a thickness of 0.05 mm, wherein the amount of bite into the cleaning roller 111 in the image forming region G was 0.5 mm and the angle of abutment against the cleaning roller 111 was 12°.

The toner layer restricting member 120, as shown in FIG. 3, has inclined portions 121 formed at both ends thereof in the direction Y transverse to the direction of conveyance in both the lateral regions outside of the image forming region G.

In Experiment 1, in relation to the amount of bite of the inclined portions 121 into the cleaning roller 111, an examination was conducted of the relationship between the amount of bite and the level difference formed at the ends of the cleaning roller 111 due to abrasion.

The results shown in Table 1 were obtained as results of Experiment 1. Table 1 shows the relationship among the level difference at the ends of the surface of the cleaning roller 111 due to abrasion, the amount of bite of the inclined portions 121, and the recurvature of the toner layer restricting member 120 after printing on half a million paper sheets.

TABLE 1

| Amount of Bite of Inclined Portions into Cleaning Roller (mm) | Level Difference at Ends of Cleaning Roller (μm) | Recurvature of Toner Layer Restricting Member |
|---|---|---|
| 0.5 | 720 | Occurred |
| 0.3 | 490 | Occurred |
| 0.2 | 350 | Occurred |
| 0.1 | 150 | Not occurred |

As shown in Table 1, the results of Experiment 1 show that when the amount of bite of the inclined portions 121 into the cleaning roller 111 was 0.5 to 0.2 mm, the toner layer restricting member 120 was recurved at the ends in the direction Y transverse to the direction of conveyance. When the amount of bite of the inclined portions 121 was 0.1 mm, the toner layer restricting member 120 was not recurved. Therefore, in order to prevent the occurrence of recurvature of the toner layer restricting member 120, it is necessary to set the amount of bite of the inclined portions 121 at 0.1 mm or less.

Experiment 2

In Experiment 2, an examination was conducted on the amount of bite of the inclined portions 121 into the ends of the cleaning roller 111 in the direction Y transverse to the direction of conveyance from the viewpoint of whether or not toner leaked from between the cleaning roller 111 and the toner layer restricting member 120 depending upon the amount of bite of the inclined portions 121.

The conditions of Experiment 2 are as follows:

In addition to the conditions of Experiment 1, two hundred thousand A4-size paper sheets were continuously subjected to printing at a coverage rate of 20%.

In Experiment 2, an examination was conducted of the relationship between the amount of bite of the inclined portions 121 into the ends of the cleaning roller 111 in the direction Y transverse to the direction of conveyance and the amount of toner deposited on the cleaning roller 111.

Figure 5:
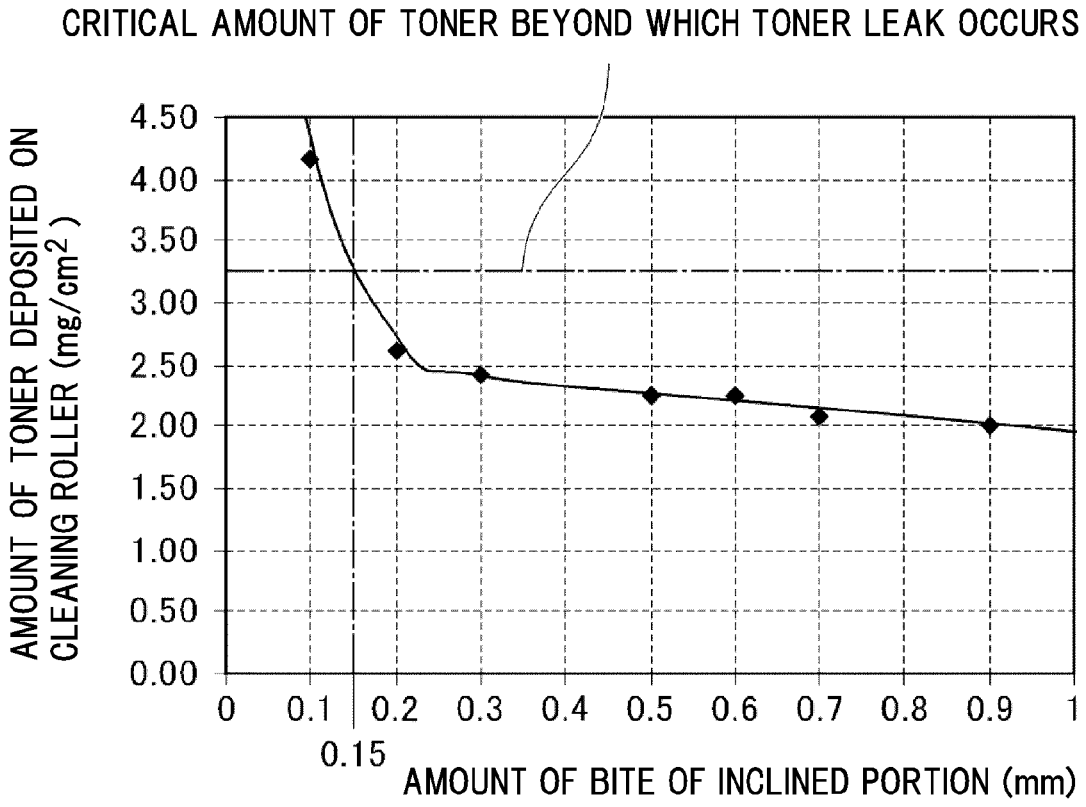
FIG. 5 is a graph showing experimental results of Experiment 2 and, more specifically, showing the relationship between the amount of bite of inclined portions into a cleaning roller and the amount of toner deposited on the cleaning roller.

The results shown in FIG. 5 were obtained as results of Experiment 2. FIG. 5 is a graph showing experimental results of Experiment 2 and, more specifically, showing the relationship between the amount of bite of the inclined portions 121 into the cleaning roller 111 and the amount of toner deposited on the cleaning roller 111.

As shown in FIG. 5, the results of Experiment 2 show that when the amount of bite of the inclined portions 121 of the toner layer restricting member 120 into the ends of the cleaning roller 111 in the direction Y transverse to the direction of conveyance was 0.1 mm, about 4.2 mg/cm$^2$ of toner was deposited on the surface of the cleaning roller 111 and toner leaked from between the cleaning roller 111 and the toner layer restricting member 120. The critical amount of bite of the inclined portions 121 into the ends of the cleaning roller 111 in the direction Y transverse to the direction of conveyance, beyond which toner leak occurs between the cleaning roller 111 and the toner layer restricting member 120, is 0.15 mm. Specifically, when the amount of bite of the inclined portions 121 was not greater than 0.15 mm, about 3.25 mg/cm$^2$ or less of toner was deposited on the surface of the cleaning roller 111 and toner leaked from between the cleaning roller 111 and the toner layer restricting member 120. On the other hand, when the amount of bite of the inclined portions 121 was greater than 0.15 mm, no toner leak occurred between the cleaning roller 111 and the toner layer restricting member 120 at the ends of the cleaning roller 111 in the direction Y transverse to the direction of conveyance.

Experiment 3

In the aforementioned Experiment 1, it was shown that in order to prevent the occurrence of recurvature of the toner layer restricting member 120 at the ends of the cleaning roller 111 in the direction Y transverse to the direction of conveyance, it is necessary to set the amount of bite of the inclined portions 121 at 0.1 mm or less. On the other hand, in the above Experiment 2, it was shown that when the amount of bite of the inclined portions 121 into the ends of the cleaning roller 111 in the direction Y transverse to the direction of conveyance was not greater than 0.1 mm, toner leak occurred between the cleaning roller 111 and the toner layer restricting member 120.

Therefore, in Experiment 3, a further examination was conducted on the amount of bite of the inclined portions 121 into the cleaning roller 111 from the viewpoint of whether or not toner leaked from between the cleaning roller 111 and the toner layer restricting member 120 depending upon the height of the upper end portion 133 of the toner receiving member 130 under the condition that the amount of bite of the inclined portions 121 was not greater than 0.1 mm.

In this case, in order to reduce toner leak under the condition that the amount of bite of the inclined portions 121 is not greater than 0.1 mm, it is necessary to reduce the amount of toner passing over the top of the toner layer restricting member 120 and an effective way to do this is to reduce the amount of toner accumulated on the toner receiving member 130. Therefore, an examination was conducted on the amount of bite of the inclined portions 121 into the ends of the cleaning roller 111 in the direction Y transverse to the direction of conveyance from the viewpoint of, under the condition that the amount of bite of the inclined portions 121 is not greater than 0.1 mm, how much the height of the upper end portion 133 of the toner receiving member 130 should be changed to reduce the amount of toner accumulated on the toner in order to prevent toner leak from between the cleaning roller 111 and the toner layer restricting member 120.

The results shown in Table 2 were obtained as results of Experiment 3. Table 2 shows the relationship between the height of the upper end portion 133 of the toner receiving member 130 and the amount of toner deposited on the cleaning roller 111.

TABLE 2

| Height from Second Contact Region to Upper End Portion (mm) | Amount of Toner on Cleaning Roller (mg/cm$^2$) | Toner Leak |
|---|---|---|
| 2 | 4.40 | Occurred |
| 1 | 4.10 | Occurred |
| 0 | 2.90 | Occurred |
| −1 | 2.20 | Not occurred |

As shown in Table 2, the results of Experiment 3 show that when the height of the upper end portion 133 of the toner receiving member 130 at the ends of the cleaning roller 111 in the direction Y transverse to the direction of conveyance was 1 mm or 2 mm greater than that of the second contact region T2 between the cleaning roller 111 and the toner supply roller 112 under the condition that the amount of bite of the inclined portions 121 was not greater than 0.1 mm, toner leaked from between the cleaning roller 111 and the toner layer restricting member 120. On the other hand, when the height of the upper end portion 133 of the toner receiving member 130 at the ends of the cleaning roller 111 in the direction Y transverse to the direction of conveyance was on the same level as (0 mm) or 1 mm lower than the center of height of the second contact region T2 between the cleaning roller 111 and the toner supply roller 112, no toner leaked from between the cleaning roller 111 and the toner layer restricting member 120.

Therefore, by setting the height of the upper end portion 133 of the toner receiving member 130 lower than the height of the second contact region T2 where the cleaning roller 111 and the toner supply roller 112 come into contact with each other, the amount of toner on the toner receiving member 130 can be reduced to prevent the occurrence of toner leak.

Hence, while the amount of bite of the inclined portions 121 at the ends of the toner layer restricting member 120 in the direction Y transverse to the direction of conveyance is set at 0.1 mm or less, the height of the second upper end portion 133B of the toner receiving member 130 close to the waste toner discharge screw 140 is set lower than the level of the second contact region T2 where the cleaning roller 111 and the toner supply roller 112 come into contact with each other.

When the amount of toner on the surface of the cleaning roller 111 in the image forming region G is reduced, the capability of the cleaning roller 111 to polish the surface of the photosensitive drum 2 is deteriorated, resulting in occurrence of a problem with image quality, such as image deletion. To cope with this, as for the image forming region G, it is preferred that, as shown in FIG. 2A, the height of the first upper end portion 133A of the toner receiving member 130 should be greater than that of the second contact region T2 where the cleaning roller 111 and the toner supply roller 112 come into contact with each other.

Next, a brief description will be given of the operation of the printer 1 according to this embodiment with reference to FIG. 1.

Paper sheets T contained in the paper feed cassette 52 are fed sheet by sheet to the first conveyance path L1 by the forward feed roller 61 and the paper feed roller pair 63 and then conveyed via the first junction P1 and the first conveyance path L1 to the registration roller pair 80.

The registration roller pair 80 performs skew correction of the paper sheet T and timing synchronization of formation of a toner image with the conveyance of the paper sheet T.

The paper sheet T sent out of the registration roller pair 80 is introduced via the first conveyance path L1 into between the photosensitive drum 2 and the transfer roller 8 (into the transfer nip N). Then, a toner image is transferred to the paper sheet T between the photosensitive drum 2 and the transfer roller 8.

Thereafter, the paper sheet T is sent from between the photosensitive drum 2 and the transfer roller 8 and introduced via the second conveyance path L2 into a fixing nip between the heat rotor 9A and the pressure rotor 9B in the fixing section 9. Then, the toner is melted at the fixing nip and thus fixed on the paper sheet T.

Subsequently, the paper sheet T is conveyed along the third conveyance path L3 to the paper discharge section 50 by the first roller pair 54A and then discharged from the paper discharge section 50 to the discharged sheet accumulating section M1 by a third roller pair 53.

In this manner, printing for the paper sheet T contained in the paper feed cassette 52 is completed.

Next, a description will be given of the operation of the drum cleaning device 11.

As shown in FIGS. 2A and 2B, residual toner is deposited on the surface of the photosensitive drum 2 after subjected to the transfer process by the transfer roller 8. When in this state the photosensitive drum 2 rotates, the toner deposited on the surface of the photosensitive drum 2 is conveyed to the first contact region T1 where the photosensitive drum 2 and the cleaning roller 111 come into contact with each other.

The cleaning roller 111 rubs on the surface of the photosensitive drum 2 to remove the toner deposited on the surface of the photosensitive drum 2. Furthermore, the cleaning roller 111 retains toner on its surface to form a layer of toner and polishes the surface of the photosensitive drum 2 with the layer of toner formed on its surface. Toner removed from the surface of the photosensitive drum 2 is deposited on the surface of the cleaning roller 111. The toner deposited on the surface of the cleaning roller 111 is conveyed downstream in the direction of rotation of the cleaning roller 111 by the rotation of the cleaning roller 111.

On the other hand, toner unremoved by the cleaning roller 111 and remaining on the surface of the photosensitive drum 2 is conveyed toward the cleaning blade 113 located downstream in the direction of rotation of the photosensitive drum 2 as it is deposited on the surface of the photosensitive drum 2. The toner conveyed to the cleaning blade 113 is scraped off from the surface of the photosensitive drum 2 by the cleaning blade 113.

The toner deposited on the surface of the cleaning roller 111 is conveyed, by the rotation of the cleaning roller 111, to the second contact region T2 where the cleaning roller 111 and the toner supply roller 112 come into contact with each other. Concurrently, toner deposited on the surface of the toner supply roller 112 is also supplied, by the rotation of the toner supply roller 112, to the second contact region T2 where the cleaning roller 111 and the toner supply roller 112 come into contact with each other.

The toner conveyed and supplied to the second contact region T2 where the cleaning roller 111 and the toner supply roller 112 come into contact with each other passes through the second contact region T2 and is then conveyed downstream of the second contact region T2.

The toner deposited on the surface of the cleaning roller 111 and conveyed downstream of the second contact region T2 is scraped off by the toner layer restricting member 120. Thus, the thickness of the layer of toner deposited on the surface of the cleaning roller 111 is restricted.

In the meanwhile, as shown in FIG. 3, the inclined portions 121 are formed at both ends of the toner layer restricting member 120. The inclined portions 121 incline gradually away from the surface of the cleaning roller 111 with increasing distance from the inner sides of the lateral regions outside of the image forming region G in the direction Y transverse to the direction of conveyance. Therefore, in the portions of the toner layer restricting member 120 corresponding to the lateral regions outside of the image forming region G, the amount of bite of the inclined portions 121 into the cleaning roller 111 gradually decreases from the inner ends toward the outer ends of the inclined portions 121. Thus, it can be prevented that, at the ends of the cleaning roller 111 in the direction Y transverse to the direction of conveyance, the toner layer restricting member 120 bites into the side surfaces of the cleaning roller 111. Hence, the recurvature of the toner layer restricting member 120 can be prevented.

Furthermore, in the lateral regions outside of the image forming region G in the toner layer restricting member 120, the amount K1 of bite of the inclined portions 121 into the cleaning roller 111 is 0.1 mm. Therefore, the toner layer restricting member 120 can be prevented from recurving at the ends of the cleaning roller 111 in the direction Y transverse to the direction of conveyance.

On the other hand, in the image forming region G, the amount K2 of bite of the toner layer restricting member 120 into the cleaning roller 111 is greater than 0.1 mm. Therefore, in the image forming region G, the toner layer restricting member 120 can sufficiently scrape off toner from the surface of the cleaning roller 111.

The toner scraped off by the toner layer restricting member 120, as shown in FIGS. 2A and 2B, is received by the toner receiving member 130. The toner deposited on the surface of the toner supply roller 112 and conveyed downstream of the second contact region T2 is received by the toner receiving member 130 or conveyed toward the second contact region T2 by the rotation of the toner supply roller 112.

The toner received by the toner receiving member 130 is supplied to the toner supply roller 112. In the image forming region G, as shown in FIG. 2A, the toner received by the toner receiving member 130 is accumulated thereon until it reaches the first upper end portion 133A. The toner accumulated on the toner receiving member 130 and having reached the first upper end portion 133A, as shown in FIG. 2A, is pushed out from the first upper end portion 133A of the toner receiving member 130 and falls down toward the waste toner discharge screw 140.

In the lateral regions outside of the image forming region G, as shown in FIG. 2B, the toner received by the toner receiving member 130 is accumulated thereon until it reaches the second upper end portions 133B. The toner accumulated on the toner receiving member 130 and having reached the second upper end portions 133B, as shown in FIG. 2B, is pushed out from the second upper end portions 133B of the toner receiving member 130 and falls down toward the waste toner discharge screw 140.

In this relation, in the lateral regions outside of the image forming region G, the height of the second upper end portions 133B is smaller than that of the second contact region T2 where the cleaning roller 111 and the toner supply roller 112 come into contact with each other. Therefore, in the lateral regions outside of the image forming G, the toner received by and accumulated on the toner receiving member 130 is pushed out and falls down through the second upper end portions 133B lower than the second contact region T2 toward the waste toner discharge screw 140.

Since the height of the second upper end portions 133B is smaller than that of the second contact regions T2, the amount of toner accumulated on the toner receiving member 130 is reduced as compared to the case where the height of the second upper end portions 133B is greater than that of the second contact region T2. Therefore, the amount of toner flowing toward between the cleaning roller 111 and the toner layer restricting member 120 is also reduced. Hence, even when the amount of bite of the inclined portions 121 of the toner layer restricting member 120 in the lateral regions outside of the image forming region G is 0.1 mm, toner leak from between the cleaning roller 111 and the toner layer restricting member 120 can be prevented.

The toner supplied from the toner receiving member 130 to the toner supply roller 112 is conveyed, by the rotation of the toner supply roller 112, toward the second contact region T2 where the cleaning roller 111 and the toner supply roller 112 come into contact with each other.

In a general cleaning device including a toner supply roller configured to supply toner to the cleaning roller and a toner receiving member configured to receive toner and supply the received toner to the toner supply roller, a toner layer restricting member abuts against the surface of the cleaning roller. Therefore, in the general cleaning device, a portion of the surface of the cleaning roller abutting against the toner layer restricting member may have a level difference due to abrasion from the toner layer restricting member. If the abrasion of the cleaning roller from the toner layer restricting member progresses to increase the level difference, portions of the toner layer restricting member corresponding to the ends of the cleaning roller in the direction along the rotational axis may bite into the side surfaces of the cleaning roller and thus may recurve.

Unlike the above, the drum cleaning device 11 according to this embodiment produces, for example, the following effects.

In this embodiment, the drum cleaning device 11 includes the cleaning roller 111 configured to remove toner from the surface of the photosensitive drum 2, the cleaning blade 113, the toner supply roller 112 disposed in contact at the second contact region T2 with the surface of the cleaning roller 11, the toner layer restricting member 120 disposed in abutment against the surface of the cleaning roller 111, and the toner receiving member 130 disposed facing the toner supply roller 112, wherein the toner layer restricting member 120 includes the inclined portions 121 formed in the lateral regions outside of the image forming region G to incline gradually away from the surface of the cleaning roller 111 with distance from the inner sides of the lateral regions in the direction Y transverse to the direction of conveyance, the toner receiving member 130 includes the second upper end portions 133B provided in the lateral regions outside of the image forming region G and located below the second contact region T2, and the inclined portions 121 are disposed in regions overlapping the second upper end portions 133B when viewed from the direction perpendicular to the direction Y transverse to the direction of conveyance (the direction along the second rotational axis).

As just described, the inclined portions 121 incline gradually away from the surface of the cleaning roller 111 with increasing distance from the inner sides of the lateral regions outside of the image forming region G in the direction Y transverse to the direction of conveyance. Therefore, in the portions of the toner layer restricting member 120 corresponding to the lateral regions outside of the image forming region G, the amount of bite of the inclined portions 121 into the cleaning roller 111 gradually decreases from the inner ends toward the outer ends of the inclined portions 121. Thus, it can be prevented that, at the ends of the cleaning roller 111 in the direction Y transverse to the direction of conveyance, the toner layer restricting member 120 bites into the side surfaces of the cleaning roller 111. Hence, the recurvature of the toner layer restricting member 120 can be prevented.

Furthermore, since the height of the second upper end portions 133B is smaller than that of the second contact regions T2, the amount of toner accumulated on the toner receiving member 130 is reduced as compared to the case where the height of the second upper end portions 133B is greater than that of the second contact region T2. Therefore, the amount of toner flowing toward between the cleaning roller 111 and the toner layer restricting member 120 is also reduced. Thus, even when the amount of bite of the inclined portions 121 of the toner layer restricting member 120 in the lateral regions outside of the image forming region G is 0.1 mm, toner leak from between the cleaning roller 111 and the toner layer restricting member 120 can be prevented. Hence, toner leak to the outside of the cleaning device 11 can be prevented.

In this embodiment, the inner end 134 of each of the second upper end portions 133B, 133B in the direction Y transverse to the direction of conveyance is located between a portion of the toner receiving member 130 corresponding to the image forming region G and a portion thereof corresponding to the associated inclined portion 121 in the direction Y transverse to the direction of conveyance. Thus, in the lateral regions outside of the image forming region G, the toner receiving member 130 can prevent toner leak from between the cleaning roller 111 and the toner layer restricting member 120. Furthermore, in the image forming region G, the toner receiving member 130 can sufficiently supply toner to the surface of the cleaning roller 111 and thus prevent deterioration of the capability of the cleaning roller 111 to polish the surface of the photosensitive drum 2.

In this embodiment, the amount of bite of the inclined portions 121 into the cleaning roller 111 is 0.1 mm or less. Therefore, in the lateral regions outside of the image forming region G, the recurvature of the toner layer restricting member 120 due to the inclined portions 121 can be further prevented.

In this embodiment, in the region of the toner layer restricting member 120 located inwardly of the inclined portions 121 in the direction Y transverse to the direction of conveyance, the amount of bite of the toner layer restricting member 120 into the cleaning roller 111 is greater than 0.1 mm. Therefore, in the image forming region G, the toner layer restricting member 120 can sufficiently scrape off toner from the surface of the cleaning roller 111 to restrict the thickness of the layer of toner.

In this embodiment, the toner receiving surface 131A is formed to have a curvature along the peripheral surface of the toner supply roller 112. Therefore, the toner receiving member 130 can easily receive toner from the toner supply roller 112 and the toner received by the toner receiving member 130 can be efficiently supplied to the toner supply roller 112.

In this embodiment, the toner receiving member 130 includes, in the image forming region G, the first upper end portion 133A located above the second contact region T2. Therefore, it can be prevented that the amount of toner on the surface of the cleaning roller 111 in the image forming region G is reduced to deteriorate the capability of the cleaning roller 111 to polish the surface of the photosensitive drum 2.

Although the preferred embodiment of the present disclosure has been heretofore described, the present disclosure is not limited by the above embodiment and can be implemented in various forms.

For example, although the description in the above embodiment has been given of the black-and-white printer 1 as the image forming apparatus, the image forming apparatus according to the present disclosure is not limited to this and may be, for example, a copier, a color printer, a facsimile machine or a multifunction peripheral including these devices.

Although the description in the above embodiment has been given of the case where the drum cleaning device 11 is used as a cleaning device for use in removing toner from the surface of the photosensitive drum 2 as the image carrier, the cleaning device according to the one embodiment of the present disclosure is not necessarily limited to this case. The drum cleaning device 11 including the cleaning roller 111, the toner supply roller 112, the cleaning blade 113, the toner layer restricting member 120, and the toner receiving member 130, which has been described in the above embodiment, may be applied to a cleaning device for use in removing toner adhering to other members in the printer 1.

For example, toner remaining on the surface of the photosensitive drum 2 may adhere to the surface of the charging roller of the charging section 10. A cleaning device having the same structure as the drum cleaning device 11 can be used as a cleaning device provided to remove toner adhering to the surface of the charging roller. For another example, a color copier is provided with an intermediate transfer belt in order to superpose toner images of different colors formed on different photosensitive drums. The intermediate transfer belt is provided together with a cleaning device for use in removing residual toner remaining on the belt after transfer of the superposed toner images to the paper sheet. A cleaning device having the same structure as the drum cleaning device 11 can be used as the cleaning device for the intermediate transfer belt.

In other words, in the cleaning device according to these modifications, the cleaning roller is disposed in contact at a first contact region with a surface of a member rotatable about a first rotational axis, is rotatable about a second rotational axis parallel to the first rotational axis, extends in a direction along the second rotational axis, and is configured to remove toner from the surface of the member.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A cleaning device comprising:

a cleaning roller which is disposed in contact at a first contact region with a surface of an image carrier rotatable about a first rotational axis, is rotatable about a second rotational axis parallel to the first rotational axis, extends in a direction along the second rotational axis, and is configured to remove toner from the surface of the image carrier;

a cleaning blade which is disposed in abutment against the surface of the image carrier downstream of the first contact region in a direction of rotation of the image carrier, extends in the direction along the second rotational axis, and is configured to scrape off toner from the surface of the image carrier;

a toner supply roller which is disposed in contact at a second contact region with a surface of the cleaning roller, is rotatable about a third rotational axis parallel to the second rotational axis, extends in a direction along the third rotational axis, and is configured to supply toner to the cleaning roller;

a toner layer restricting member which is disposed in abutment against the surface of the cleaning roller downstream of the second contact region in a direction of rotation of the cleaning roller, extends in the direction along the second rotational axis, and is configured to restrict a thickness of a layer of toner deposited on the cleaning roller; and a toner receiving member which is disposed apart from and facing the toner supply roller downstream of the second contact region in a direction of rotation of the toner supply roller, extends in the direction along the third rotational axis, includes a toner receiving surface facing a peripheral surface of the toner supply roller, and is configured to receive toner having passed through the second contact region and supply the received toner to the toner supply roller, wherein the toner layer restricting member includes an inclined portion formed in a lateral region outside of an image forming region to incline gradually away from the surface of the cleaning roller with increasing distance from an inner side of the lateral region in the direction along the second rotational axis, the toner receiving member includes a lower-level upper end portion provided in the lateral region outside of the image forming region, the lower-level upper end portion being located below the second contact region, and the inclined portion is disposed in a region overlapping the lower-level upper end portion when viewed from a direction perpendicular to the direction along the second rotational axis.

2. The cleaning device according to claim 1, wherein an inner end of the lower-level upper end portion in the direction along the third rotational axis is located between a portion of the toner receiving member corresponding to the image forming region and a portion thereof corresponding to the inclined portion in the direction along the third rotational axis.

3. The cleaning device according to claim 1, wherein the amount of bite of the inclined portion into the cleaning roller is 0.1 mm or less.

4. The cleaning device according to claim 1, wherein in a region of the toner layer restricting member located inwardly of the inclined portion in the direction along the second rotational axis, the amount of bite of the toner layer restricting member into the cleaning roller is greater than 0.1 mm.

5. The cleaning device according to claim 1, wherein the toner receiving surface is curved along a peripheral surface of the toner supply roller.

6. The cleaning device according to claim 1, wherein the toner receiving member includes, in the image forming region, an upper-level upper end portion located above the second contact region.

7. An image forming apparatus comprising:

an image carrier having a surface on which an electrostatic latent image is to be formed;

a developing device configured to develop the electrostatic latent image formed on the image carrier into a toner image; and a cleaning device, wherein the cleaning device comprises:

a cleaning roller which is disposed in contact at a first contact region with a surface of the image carrier rotatable about a first rotational axis, is rotatable about a second rotational axis parallel to the first rotational axis, extends in a direction along the second rotational axis, and is configured to remove toner from the surface of the image carrier;

a cleaning blade which is disposed in abutment against the surface of the image carrier downstream of the first contact region in a direction of rotation of the image carrier, extends in the direction along the second rotational axis, and is configured to scrape off toner from the surface of the image carrier;

a toner supply roller which is disposed in contact at a second contact region with a surface of the cleaning roller, is rotatable about a third rotational axis parallel to the second rotational axis, extends in a direction along the third rotational axis, and is configured to supply toner to the cleaning roller;

a toner layer restricting member which is disposed in abutment against the surface of the cleaning roller downstream of the second contact region in a direction of rotation of the cleaning roller, extends in the direction along the second rotational axis, and is configured to restrict a thickness of a layer of toner deposited on the cleaning roller; and a toner receiving member which is disposed apart from and facing the toner supply roller downstream of the second contact region in a direction of rotation of the toner supply roller, extends in the direction along the third rotational axis, includes a toner receiving surface facing a peripheral surface of the toner supply roller, and is configured to receive toner having passed through the second contact region and supply the received toner to the toner supply roller, wherein the toner layer restricting member includes an inclined portion formed in a lateral region outside of an image forming region to incline gradually away from the surface of the cleaning roller with increasing distance from an inner side of the lateral region in the direction along the second rotational axis, wherein the toner receiving member includes a lower-level upper end portion provided in the lateral region outside of the image forming region, the lower-level upper end portion being located below the second contact region, and wherein the inclined portion is disposed in a region overlapping the lower-level upper end portion when viewed from a direction perpendicular to the direction along the second rotational axis.

8. A cleaning device comprising:

a cleaning roller which is disposed in contact at a first contact region with a surface of a member rotatable about a first rotational axis, is rotatable about a second rotational axis parallel to the first rotational axis, extends in a direction along the second rotational axis, and is configured to remove toner from the surface of the member;

a cleaning blade which is disposed in abutment against the surface of the member downstream of the first contact region in a direction of rotation of the member, extends in the direction along the second rotational axis, and is configured to scrape off toner from the surface of the member;

a toner supply roller which is disposed in contact at a second contact region with a surface of the cleaning roller, is rotatable about a third rotational axis parallel to the second rotational axis, extends in a direction along the third rotational axis, and is configured to supply toner to the cleaning roller;

a toner layer restricting member which is disposed in abutment against the surface of the cleaning roller downstream of the second contact region in a direction of rotation of the cleaning roller, extends in the direction along the second rotational axis, and is configured to restrict a thickness of a layer of toner deposited on the cleaning roller; and a toner receiving member which is disposed apart from and facing the toner supply roller downstream of the second contact region in a direction of rotation of the toner supply roller, extends in the direction along the third rotational axis, includes a toner receiving surface facing a peripheral surface of the toner supply roller, and is configured to receive toner having passed through the second contact region and supply the received toner to the toner supply roller, wherein the toner layer restricting member includes an inclined portion formed in a lateral region outside of an image forming region to incline gradually away from the surface of the cleaning roller with increasing distance from an inner side of the lateral region in the direction along the second rotational axis, the toner receiving member includes a lower-level upper end portion provided in the lateral region outside of the image forming region, the lower-level upper end portion being located below the second contact region, and the inclined portion is disposed in a region overlapping the lower-level upper end portion when viewed from a direction perpendicular to the direction along the second rotational axis.

* * * * *